United States Patent [19]

Wooldridge et al.

[11] 4,455,155

[45] Jun. 19, 1984

[54] ELECTROSTATIC COLLECTING ASSEMBLY

[75] Inventors: James E. Wooldridge; Karl L. Westlin, both of Louisville, Ky.

[73] Assignee: Allis-Chalmers Corp., Milwaukee, Wis.

[21] Appl. No.: 403,783

[22] Filed: Jul. 30, 1982

[51] Int. Cl.[3] ..... B03C 3/74

[52] U.S. Cl. ..... 55/13; 55/118; 55/271; 55/242; 239/70; 239/113; 239/413; 239/415

[58] Field of Search ..... 55/2, 10, 13, 106, 107, 55/117–120, 122, 137, 143, 145, 233, 242, 323, 324; 261/98; 239/70, 113, 415, 413

[56] References Cited

U.S. PATENT DOCUMENTS

| | | | |
|---|---|---|---|
| 1,983,338 | 12/1934 | Bragg | 55/10 |
| 2,160,549 | 5/1939 | Kurth | 261/98 |
| 2,542,054 | 2/1951 | Penney et al. | 55/10 |
| 2,633,929 | 4/1953 | Farr | 55/233 |
| 2,853,150 | 9/1958 | Linehan | 55/118 |
| 2,874,802 | 2/1959 | Gustafsson et al. | 55/13 |
| 4,134,741 | 1/1979 | Eisbernd et al. | 55/13 |
| 4,332,597 | 6/1982 | Wooldridge | 55/138 |

*Primary Examiner*—Bernard Nozick
*Attorney, Agent, or Firm*—Arthur L. Nelson

[57] ABSTRACT

A collecting assembly for removing liquid vapors and particulates from a dirty gas stream including a housing having a dirty gas inlet and a clean gas outlet, a gas treating passage extending through the housing interconnecting the gas inlet and the gas outlet, a blower or fan adapted to draw the dirty gas stream into the housing through the gas inlet where it flows through an electrostatic precipitating section, and an oil spraying or fogging assembly adapted to periodically spray an atomized oil mist onto the discharge and collecting plates of an electrostatic collecting assembly mounted in the precipitating section to irrigate and wash accumulated particulates off the plates while continuing gas cleaning operations.

10 Claims, 5 Drawing Figures

ELECTROSTATIC COLLECTING ASSEMBLY

BACKGROUND OF THE INVENTION

1. Field of the Invention

The present invention relates to electrostatic precipitators and in particular to a method and apparatus for cleaning the precipitator during gas cleaning operations.

2. Description of the Prior Art

In a typical electrostatic precipitator, a plurality of charged and grounded electrode plates are alternately arranged to electrostatically treat a dirty gas stream flowing between the plates to remove particulates entrained in the gas stream during gas cleaning operations. In such arrangements, it has often been the practice to coat the electrode plates with a suitable film of adhesive to enhance capture and retention of the particulates as the gas stream flows through the precipitator. However, when this is done, it is periodically necessary to stop precipitating operations so the accumulated particulates can be cleaned off the plates before precipitating operations can be continued.

U.S. Pat. No. 3,505,786 shows an electrostatic precipitator which is fairly typical of those currently in use. In that arrangement, a plurality of nozzles are positioned on the upstream side of the electrode plates which are adapted to periodically direct a spray of washing fluid onto the plates when precipitating operations are interrupted to flush away the accumulated particulates on the plates.

While arrangements such as the foregoing have been satisfactory in many applications, it requires that precipitating operations be interrupted while the electrode plates are being cleaned since excessive fluid on the plates tends to promote arcing or electrical shorting between the plates of the precipitator if they are flushed when they are energized. Arcing of this nature has been found to significantly reduce the efficiency of the power supply used to energize the precipitator, and in some applications such arcing renders the precipitator totally inoperative until the fluid drains from the plates. Thus, although temporarily interrupting the precipitating process is acceptable in some applications, in the typical industrial application where the unit is used to remove various vapors and the like from machine operator's work stations, it has generally been necessary to also shutdown the machinery generating the vapors until the flushing operation is completed. This, of course, can result in costly machine downtime and operator expense when unforeseen scheduling problems develop during routine manufacturing operations.

SUMMARY OF THE INVENTION

The present invention relates to electrostatic collecting assemblies for removing liquid vapors and particulates from a dirty gas stream and in particular to a method and apparatus for cleaning the collecting plates of a collecting assembly while continuing gas cleaning operations.

The collecting assembly includes a housing having a dirty gas inlet and a clean gas outlet, a gas treating passage extending through the housing interconnecting the gas inlet and the gas outlet, a blower or fan adapted to draw or direct a dirty gas stream into the housing through the gas inlet where it flows through an electrostatic precipitating section, and oil spraying or fogging assemblies adapted to periodically spray an atomized oil mist onto discharge and collecting plates in the precipitating section to irrigate and wash accumulated particulates off the plates while continuing gas cleaning operations. The invention essentially minimizes the possibility of deleterious electrical arcing between the adjacent plates of the precipitator by maintaining relatively small and uniform sizing of the oil droplets periodically sprayed onto the plates by the fogging assembly during the plate washing cycle. This enables an operator to continue gas cleaning operations without having to de-energize the precipitator during the periodic plate cleaning cycles as discussed above in regard to the prior art. Moreover, by mounting the vertically extending discharge and collecting plates at an acute angle to the horizontal, the arrangement promotes a lateral or diagonal flow of the oil across the plates which further abates the possibility of excessive arcing during operation of the assembly.

From the foregoing, it can be seen that the invention contemplates a relatively straightforward and easily maintained arrangement which is particularly suited for industrial applications; however, it is to be understood various changes can be made in the arrangement, form, and construction of the apparatus disclosed herein without departing from the scope and spirit of the invention.

DESCRIPTION OF THE PREFERRED EMBODIMENT

Figure 1:
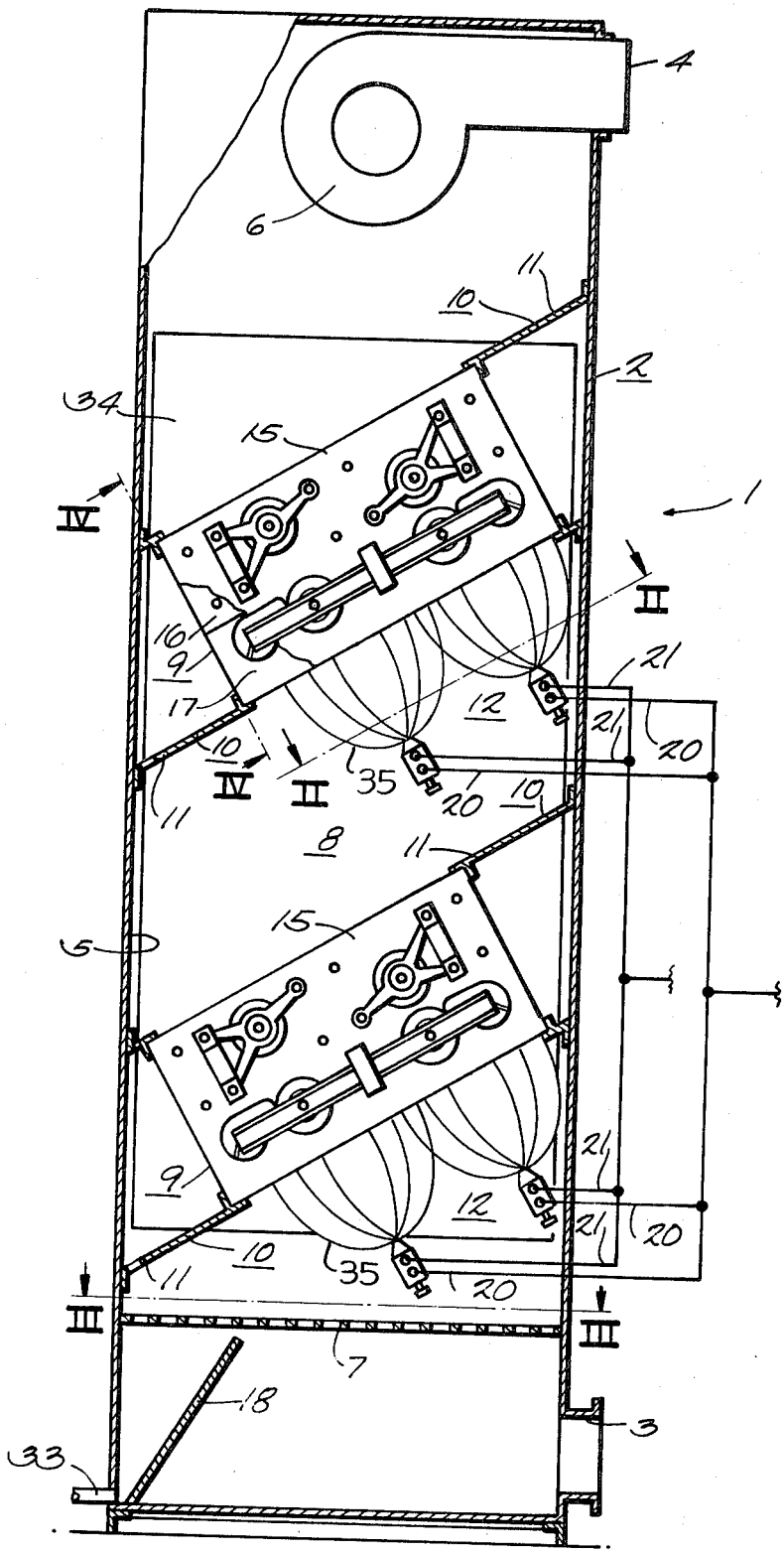
FIG. 1 is a side elevational view, partially in section, of the electrostatic collecting assembly embodying the invention.
Figure 2:
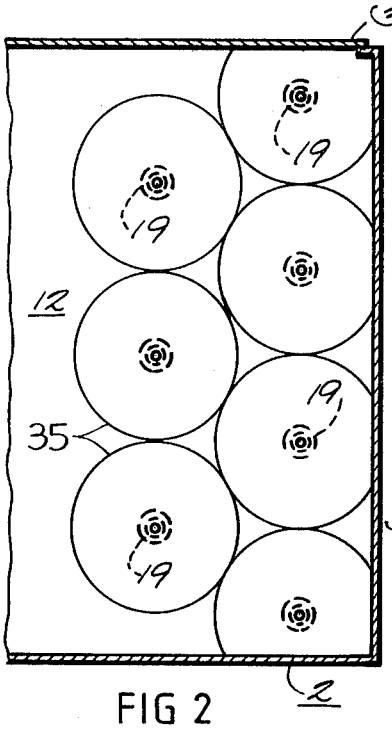
FIG. 2 is a cross-sectional view taken substantially along line II—II in FIG. 1.
Figure 3:
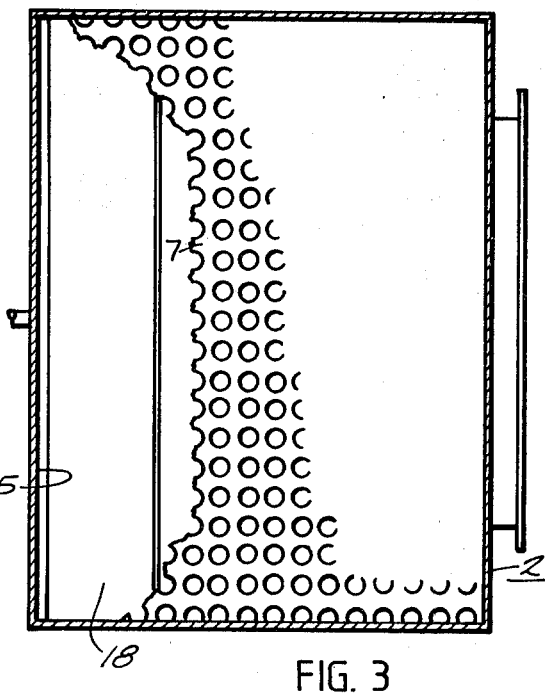
FIG. 3 is a cross-sectional view taken substantially along line III—III in FIG. 1.

Referring to FIGS. 1–3, the collecting assembly 1 embodying the invention includes a vertical housing 2 having a dirty gas inlet 3 at the base of the housing, a clean gas outlet 4 at the top of the housing, a gas treating passage 5 extending through the housing connecting the gas inlet 3 to the gas outlet 4, and a blower or fan 6 connected with the gas outlet 4 adapted to draw a dirty gas stream into the housing through the gas inlet 3 where it flows upwardly through a first perforated plate 7 secured across the treating passage 5 which disperses the incoming gases to form a relatively uniform gas stream across the width of the passage 5. Thereafter, as the gas stream flows upwardly in the passage, it flows through an electrostatic precipitating section 8 where oil mist and particulates are removed from the gas stream which is in turn discharged from the housing through the gas outlet 4.

As shown in the drawings, a pair of serially aligned electrostatic precipitators 9 are mounted in vertically spaced relation across the precipitating section 8 on a pair of frames 10 secured about the interior periphery of the housing 2. Each frame 10 is secured in parallel to the other across the precipitating section 8 at an acute angle of approximately 30 degrees to the horizontal and includes baffle or plate portions 11 about its periphery extending between the walls of the housing and its respective precipitator 9 which are adapted to direct or channel the gas stream through the precipitators during gas cleaning operations. Additionally, as shown in FIGS. 1 and 2, an oil spraying or fogging assembly 12 is provided on the lower or upstream side of each of the precipitators 9 to periodically irrigate and wash accumulated particulates out of the precipitators while maintaining continuous, uninterrupted gas cleaning operations as will be described.

Figure 4:
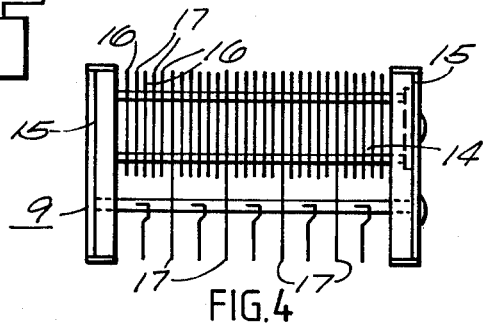
FIG. 4 is a view taken substantially along line IV—IV in FIG. 1 showing one of the precipitators.

As shown in FIG. 4, each of the electrostatic precipitators 9 is similar to the precipitator described in U.S. Pat. No. 3,505,786 which is incorporated by reference in this specification. As discussed in that patent, each of the precipitators 9 includes an electrostatically charged ionizing or discharge section 13 and a collection section 14 extending between a pair of end plates or panels 15. Although this arrangement is well known in the art and therefore is not described in detail in this specification, it should be noted that the collection section 14 is comprised of interleaved sets of grounded plates 16 and electrically charged plates 17 secured in spaced parallel relation between the end panels 15. The plates 16 and 17 are all of a rectangular configuration so when the precipitators are mounted on the frames 10 the lower edges of the plates 16 and 17 extend at an acute angle to the horizonal with the lowermost corners of the plates aligned above a channel or drain trough 18 extending across the treating passage 5 at the base of the housing 2. Additionally, although it is not described in detail in this specification, the precipitators are preferably removably secured on the frames in any well known manner accommodating their installation and removal from the housing through an access door 34 provided in the wall of the housing.

Figure 5:
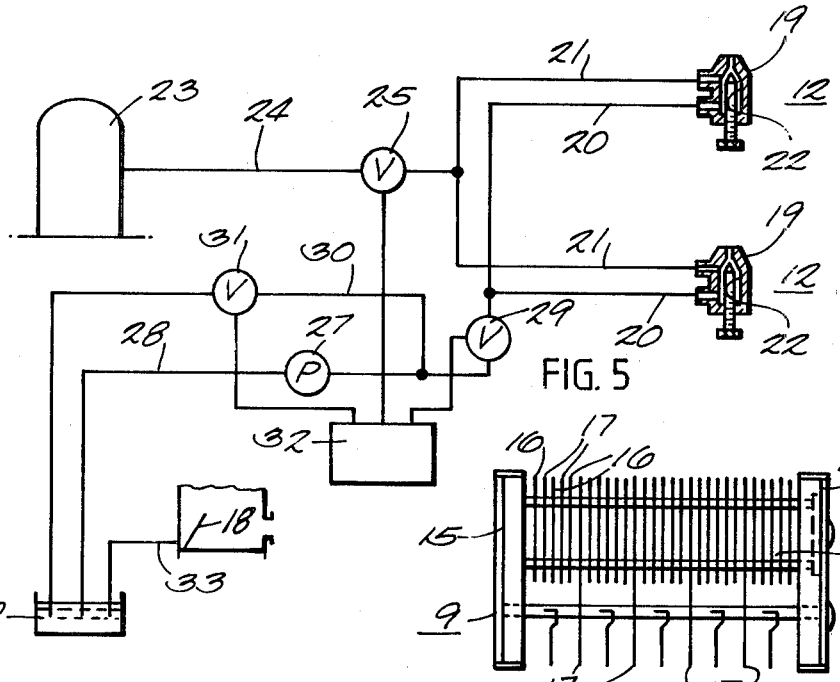
FIG. 5 is a schematic diagram of the air and oil supply system for the fogging assemblies.

Referring to FIGS. 2 and 5, each of the fogging assemblies 12 includes an array of nozzles 19 which are adapted to periodically spray a fog of oil onto the plates of the precipitators. Each of the nozzles 19 is connected with an oil supply pipe 20 and an air supply pipe 21 which are adapted to feed metered streams of air and oil into a mixing chamber 22 in the nozzle 19 where the oil is atomized in the air stream and in turn sprayed onto the plates as shown schematically in the drawings. In this regard, it is to be understood that any one of a variety of commercially available atomizing nozzle designs are suitable for this purpose.

As shown in FIG. 5, the air supply pipe 21 is connected to a source of pressurized air 23 by piping 24 having a first solenoid valve 25 in the piping 24 which is adapted to regulate the flow of air into the nozzles 19 from the source of pressurized air. In most industrial applications, the factory's industrial air supply system can be used as the air source. Similarly, the fogging oil supplied to the nozzles 19 can be supplied from the oil supply tank or reservoir used to supply machine cooling oil to the various machining stations in the factory. As shown in the drawing, the oil supply pipe 20 is connected with a reservoir 26 through a pump 27 by piping 28 including a second solenoid valve 29 adapted to regulate the flow of oil as it is pumped into the nozzles 19 of the pump 27. This arrangement also includes bypass or return piping 30 including a third solenoid valve 31 which is adapted to circulate the oil to additional collecting units in the plant, or alternatively, back to the reservoir 26. Additionally, a valve controller or electrical timing mechanism 32 is operably connected with each of the solenoid valves 25, 29 and 31 to periodically open and close the valves at preselected intervals as will be described.

During normal gas cleaning operations, the valves 25 and 29 are closed and valve 31 is kept open to maintain oil circulation in the bypass piping 30. However, when periodically initiating the cleaning cycle to clean the plates in the precipitators, the valve 31 is closed and the valves 25 and 29 are opened to direct oil and air into the nozzles 19. In the typical industrial application where the collecting assembly 1 is used to remove noxious oil vapors and suspended particulates in the air resulting during machining operations, it has been found that deleterious agglomerations of particulates and oil sludge begin to accumulate on the plates in the precipitators after about 30 minutes. Thus, in such a situation, the timing mechanism 32 is set to activate the plate cleaning cycle at 30 minute intervals. In this regard, it should be particularly noted the plate cleaning cycle can be completed without stopping normal gas cleaning operations. This is accomplished by programming the timing mechanism 32 to sequentially open and close the valves 25, 29 and 31 during the start and finish of each plate cleaning cycle. This procedure has been found to maintain the atomized oil droplets at a relatively small and uniform sizing which prevents larger droplets from sputtering out of the nozzle at the start and finish of the cleaning cycle. Thus, precipitating operations can be maintained throughout the cycle without excessive arcing between the plates of the precipitator. For example, when beginning the cleaning cycle in this arrangement, the timing mechanism 32 is set to open the air valve 25 about 5 seconds before it simultaneously closes the oil return valve 31 and opens the oil valve 29. When the oil valve 29 is opened, the nozzles 19 begin spraying a cleaning fog of oil droplets onto the plates of the precipitators as generally indicated at 35 in the drawings. Typically, this spraying phase is continued for about 20 seconds whereafter the oil valve 29 is closed and the oil return valve 31 is opened to reestablish circulation of the oil through the return piping 30 while maintaining the flow of air through the nozzles via air valve 25 for about 5 seconds after the oil valve 29 is closed. Then, the timing mechanism completes the cycle by closing the air valve 25 until the cycle is repeated 30 minutes later.

In addition to the foregoing, the manner in which the precipitators 9 are mounted within the housing also serves to minimize arcing between the adjacent plates of the precipitators. As noted above, each of the precipitators 9 is mounted at an acute angle so the lowermost corners of the plates 16 and 17 are aligned above a channel or drain trough 18 extending across the bottom of the treating passage 5. Testing has shown this effectively promotes a lateral or diagonal flow of the oil film resulting from the oil mist collected on the plates during operation of the precipitators which serves to wash the plates while at the same time channeling the flow into the lowermost corners of the plates where the oil drops into the trough 18 and is in turn removed from the housing and circulated back to the reservoir 26 through drain piping 33. This arrangement has been found to substantially reduce the development of oil beads or ribbons of oil along the lower edges of the plates since it channels the oil into the corners of the plates where it more readily flows off the plates. Consequently, by retarding the formation of relatively thick oil beads along the lower edges of the plates, the invention provides for maintaining a constant electrical spacing between each of the adjacent plates so an optimum electrical potential can be maintained between the plates during gas cleaning operations without excessive arcing between the plates.

The embodiments of the invention in which an exclusive property or privilege is claimed are defined as follows:

1. A method for periodically coating the electrodes of an electrostatic collecting assembly having an atomizing nozzle adapted to direct a spray of treating liquid containing oil onto the electrodes while continuing gas cleaning operations within the collecting assembly, comprising the sequential steps of:

continuously flowing gas through the electrostatic collecting assembly, directing a stream of pressurized air through the nozzle;

injecting a stream of treating liquid containing oil into the nozzle after the air stream has been flowing through the nozzle for a first preselected time so the liquid is entrained in the air stream in atomized small uniform droplets and sprayed onto the electrodes by the nozzle;

stopping the flow of treating liquid containing oil into the nozzle while maintaining the flow of air through the nozzle for a second preselected time after stopping the flow of treating liquid into the nozzle; and stopping the flow of air through the nozzle.

2. In an electrostatic collecting assembly including a housing having spaced gas inlet and gas outlet openings interconnected by a gas flow passage extending through the housing including a precipitating section including a precipitating unit having a plurality of spaced parallel electrode plates disposed in said gas flow passage in planes substantially parallel to the direction of gas flow through the passage, the improvement including a washer arrangement for periodically coating and washing the electrode plates with treating liquid containing oil and preventing deleterious electrical arcing while continuing gas cleaning operations within the collecting assembly, comprising:

nozzle means supported within the housing upstream of said precipitating unit;

gas piping connected with said nozzle means adapted to circulate a stream of gas into the nozzle means from a source of pressurized gas;

liquid piping connected with said nozzle means adapted to circulate treating liquid containing oil from a supply of treating liquid and inject said liquid into said nozzle means;

normally closed first valve means in said gas piping adapted to regulate the flow of gas into said nozzle means through said gas piping;

normally closed second valve means in said liquid piping adapted to regulate the flow of treating liquid containing oil into said nozzle means through said liquid piping; and valve control means operatively associated with said first and second valve means adapted to selectively open and close said first and second valve means in a preselected sequence wherein said first valve means is initially opened to direct a stream of gas into the nozzle means whereafter said second valve means is opened after a first preselected time to inject a stream of treating liquid containing oil into said nozzle means so the liquid is atomized in small unifiorm droplets and entrained in the gas stream and sprayed onto the electrode plates for a second preselected time whereupon said second valve means is closed and after a third preselected time said first valve means is closed.

3. The washer arrangement according to claim 2, and said nozzle means being disposed between the gas inlet and the precipitating section.

4. The washer arrangement according to claim 2, and said precipitating section having a plurality of electrostatic precipitating units serially aligned in the gas flow passage; and nozzle means associated with each of said precipitating units for spraying treating liquid on the respective electrode plates of said units.

5. The washer arrangement according to claim 2, and said housing including a perforated gas distribution plate extending across the gas passage between the gas inlet and the precipitating section.

6. The washer arrangement according to claim 2, and said gas flow passage extending generally vertically through the housing with the gas inlet opening at the base of the housing and the gas outlet opening at the top of the housing; and blower means connected in communication with said gas outlet opening for drawing gases through the gas flow passage.

7. The washer arrangement according to claim 2, and said gas flow passage extending vertically through the housing with the gas inlet opening at the top of the housing and the gas outlet at the base of the housing; and blower means connected in communication with said gas outlet opening for drawing gases through the gas flow passage.

8. The washer arrangement according to claim 2, and return piping connected to said fluid piping on the upstream side of said second valve means adapted to circulate treating liquid back to the liquid reservoir;

normally open third valve means in said return piping adapted to accommodate recirculation of the liquid back to the liquid reservoir; and said third valve means being operatively associated with said valve control means to close said third valve means to stop recirculation of the liquid back to the reservoir during coating and washing operations.

9. The washer arrangement according to claim 2, and each of said electrode plates being of a generally rectangular configuration wherein the lower edges of said plates are aligned to extend at an acute angle to the horizontal to promote a flow of treating liquid from each of the plates at its lowermost corner.

10. The washer arrangement according to claim 9, and said housing having a drain trough extending across the gas flow passage aligned beneath the lowermost corners of said electrode plates.

* * * * *